US008967714B2

(12) United States Patent
Machael et al.

(10) Patent No.: US 8,967,714 B2
(45) **Date of Patent: *Mar. 3, 2015**

(54) STACKING AND NESTING CHAIR

(71) Applicant: HNI Technologies Inc., Muscatine, IA (US)

(72) Inventors: Jay R. Machael, Muscatine, IA (US); Marcus C. Koepke, Indianapolis, IN (US); Andrew B. Hector, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/041,213

(22) Filed: Sep. 30, 2013

(65) Prior Publication Data

US 2014/0191546 A1 Jul. 10, 2014

Related U.S. Application Data

(63) Continuation of application No. 12/698,564, filed on Feb. 2, 2010, now Pat. No. 8,544,951.

(60) Provisional application No. 61/149,241, filed on Feb. 2, 2009.

(51) Int. Cl.
*A47C 3/04* (2006.01)
*A47C 7/00* (2006.01)

(52) U.S. Cl.
CPC ..... *A47C 3/045* (2013.01); *A47C 7/006* (2013.01)
USPC ..... 297/239

(58) Field of Classification Search
CPC ..... A47C 3/04
USPC ..... 297/239
See application file for complete search history.

(56) References Cited

U.S. PATENT DOCUMENTS

| | | | |
|---|---|---|---|
| 2,030,037 | A | 2/2000 | Ritch et al. |
| 6,142,566 | A | 11/2000 | Ritch et al. |
| 6,286,901 | B1 | 9/2001 | Ritch et al. |
| 6,742,839 | B2 | 6/2004 | Piretti |
| 7,147,286 | B2 | 12/2006 | Cesaroni et al. |
| 7,296,853 | B2 | 11/2007 | Piretti |
| 7,717,511 | B2 | 5/2010 | Huang |

(Continued)

FOREIGN PATENT DOCUMENTS

| | | | |
|---|---|---|---|
| CN | 2629546 | Y | 9/2004 |
| CN | 201064296 | Y | 5/2008 |

(Continued)

OTHER PUBLICATIONS

International Search Report and Written Opinion issued in PCT/US2010/022890, mailed Jul. 13, 2010, 14 pages.

*Primary Examiner* — Anthony D Barfield
(74) *Attorney, Agent, or Firm* — Faegre Baker Daniels LLP

(57) ABSTRACT

A stackable and nestable chair includes a seat assembly, a pair of rear legs spaced apart by a first distance, and a pair of front legs spaced apart by a second distance different than the first distance. The front legs and the rear legs mutually connected by a crossbar, and the seat assembly is supported by the crossbar when the seat is in an operable position. A plurality of casters are each attached to a bottom of each of the front and rear legs, wherein each caster includes a notch that is configured to couple with a leg of an adjacently stacked chair.

20 Claims, 9 Drawing Sheets

(56) References Cited

U.S. PATENT DOCUMENTS

| | | | |
|---|---|---|---|
| 7,794,016 | B1 | 9/2010 | Lucci et al. |
| 7,850,241 | B1 | 12/2010 | Lucci et al. |
| 8,544,951 | B2 | 10/2013 | Machael et al. |
| 2007/0222266 | A1 | 9/2007 | Lucci et al. |
| 2007/0284920 | A1 | 12/2007 | Mehaffey et al. |
| 2008/0315645 | A1 | 12/2008 | Hock |
| 2010/0194160 | A1 | 8/2010 | Machael et al. |

FOREIGN PATENT DOCUMENTS

| | | | |
|---|---|---|---|
| DE | 4135603 | A1 | 5/1992 |
| JP | 2004298434 | A | 10/2004 |

STACKING AND NESTING CHAIR

CROSS-REFERENCE TO RELATED APPLICATION

This application is a continuation of U.S. patent application Ser. No. 12/698,564, filed on Feb. 2, 2010 now U.S. Pat. No. 8,544,951, entitled "STACKING AND NESTING CHAIR," which claims priority under 35 U.S.C. §119 to U.S. Provisional Application No. 61/149,241, filed on Feb. 2, 2009, entitled "STACKING AND NESTING CHAIR," which are incorporated herein by reference in their entireties for all purposes.

TECHNICAL FIELD

The present invention relates to furniture. More specifically, the present invention relates to a chair configured for stacking and nesting when in a collapsed position.

BACKGROUND

The changing nature of the workplace has brought forth the need for flexibility in space usage. For example, instead of dedicated rooms for different functions, many companies now use the one large, open space alternatively for such activities as computer training, conferences, small group teaming for facilitating interaction, as classrooms, for panel discussions, and even as dining facilities. To allow this flexibility, new furniture concepts are needed to provide the flexibility being sought.

SUMMARY

The present invention relates to a stackable and nestable chair including a seat assembly, a pair of rear legs spaced apart by a first distance, and a pair of front legs spaced apart by a second distance different than the first distance. The front legs and the rear legs mutually connected by a crossbar, and the seat assembly is supported by the crossbar when the seat is in an operable position. A caster is attached to a bottom of each of the front and rear legs, and each caster includes a notch that is configured to couple with a leg of an adjacently stacked chair.

In another aspect, the present invention relates to a stackable and nestable chair including a seat assembly having an operable position and a collapsed position, a pair of rear legs spaced apart by a first distance, and a pair of front legs spaced apart by a second distance less than the first distance. The front legs and the rear legs are connected at a common axis by a crossbar, and the seat assembly is supported by the crossbar when the seat assembly is in the operable position. A caster is attached to a bottom of each of the front and rear legs, and each caster includes a notch that is configured to couple with a leg of an adjacently stacked stackable and nestable chair. When the seat assembly is in the collapsed position, the front legs are capable of passing between rear legs of an adjacently nested stackable and nestable chair and positionable such that, when the stackable and nestable chairs are nested, the casters on the front legs of the stackable and nestable chair are forward of the crossbar on the adjacently nested stackable and nestable chair.

In a further aspect, the present invention relates to a stackable and nestable chair including a leg assembly having two front legs and two rear legs. The front legs are connected to the rear legs by a crossbar, and the two rear legs are spaced apart by a first distance and the two front legs are spaced apart by a second distance less than the first distance. A seat assembly is pivotally mounted to the crossbar and is supported by the crossbar when the seat assembly is in an operable position. A caster is attached to a bottom of each of the front and rear legs, and each caster includes a notch that is configured to couple with a leg of an adjacently stacked stackable and nestable chair. The stackable and nestable chair is capable of being arranged in stacked and nested assemblies with other similarly configured stackable and nestable chairs.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
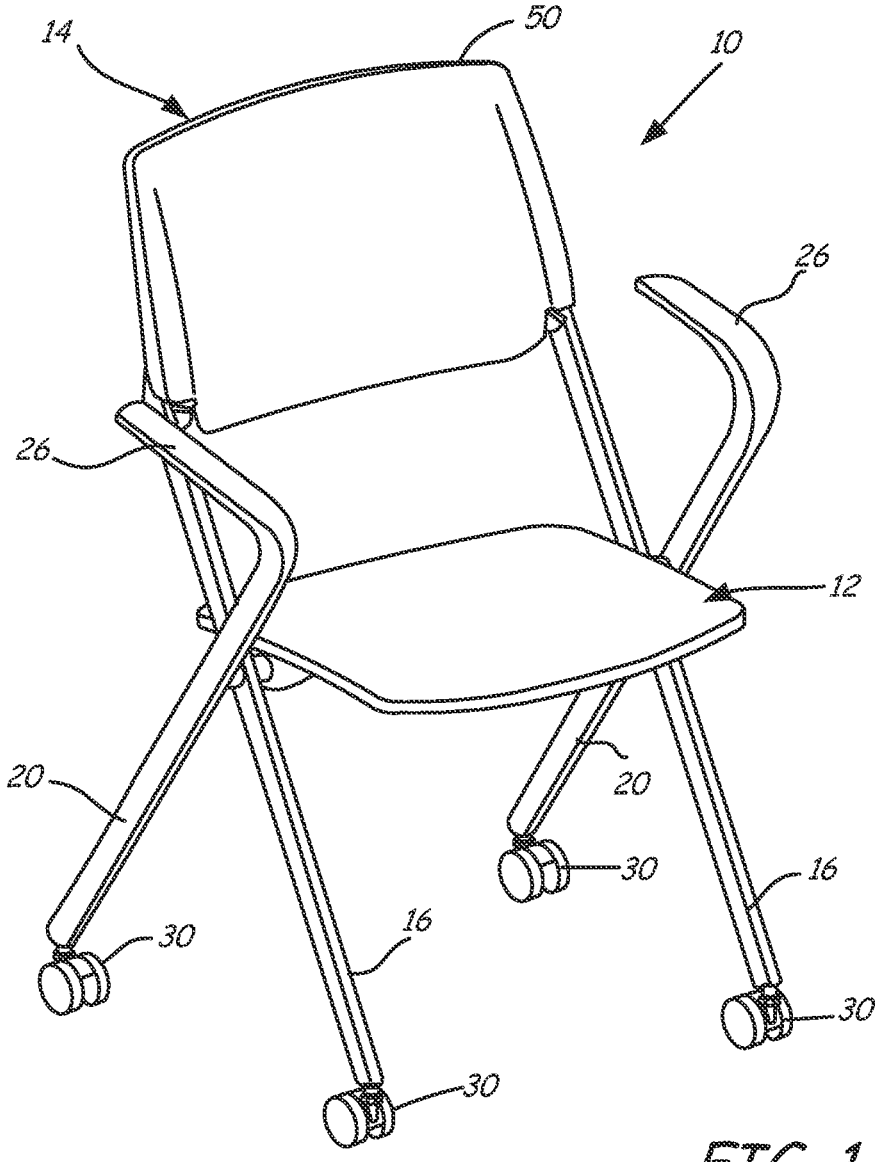
FIG. 1 is a front isometric view of an embodiment of a stackable and nestable chair in an operable position.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

The stackable and nestable chair described herein is capable of interfacing with other similar chairs in both stacked and nested configurations. The chair is stackable in the sense that the chair is capable of being vertically stacked upon other similar chairs when in a collapsed position. The chair is nestable in the sense that the chair is capable of being horizontally nested with other similar chairs when in a collapsed position. Furthermore, a stack of stackable and nestable chairs as described may be nested with other stacks of stackable and nestable chairs. A stack of the stackable and nestable chairs in the collapsed position occupy substantially the same floor space as a single stackable and nestable chair in the collapsed position. Nested stackable and nestable chairs occupy less floor space on average in a nested position than the space the chairs occupy in an operable position.

Figure 2:
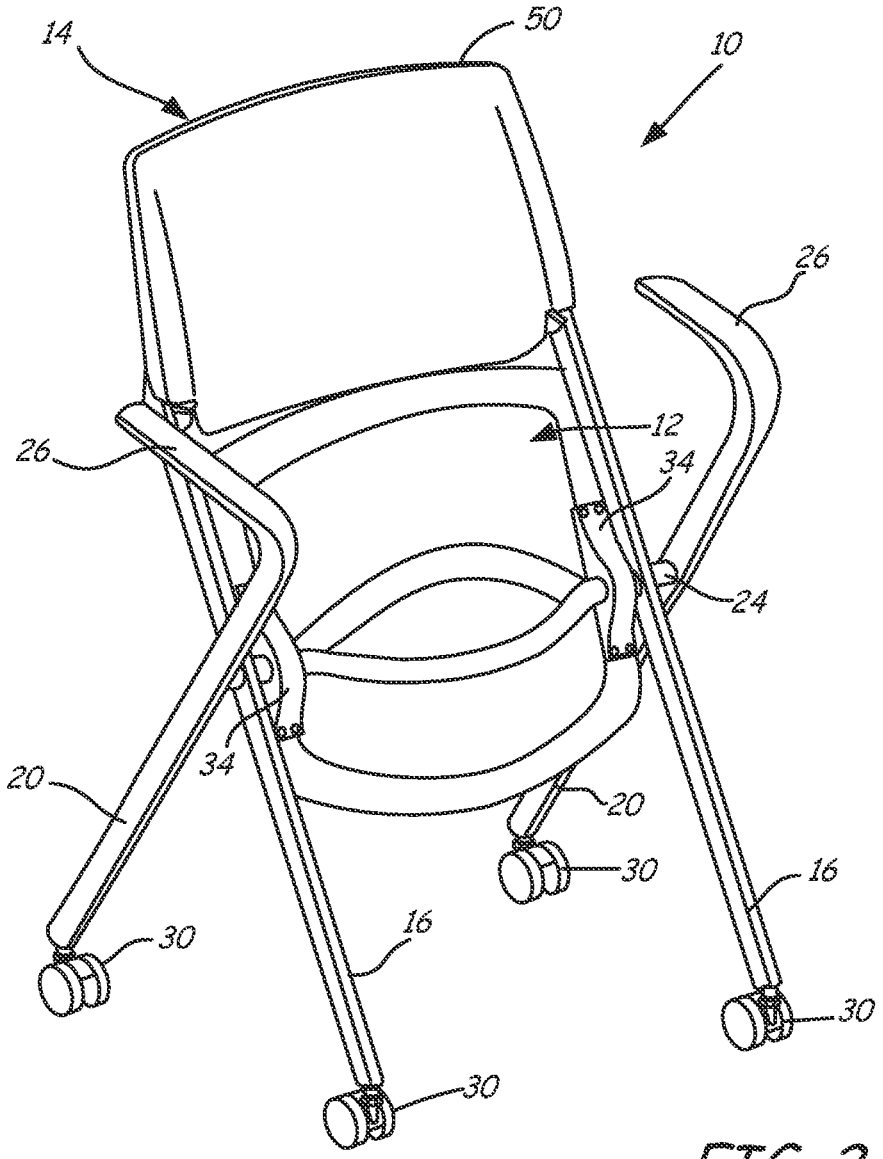
FIG. 2 is a front isometric view of the stackable and nestable chair in a collapsed or folded position.
Figure 3:
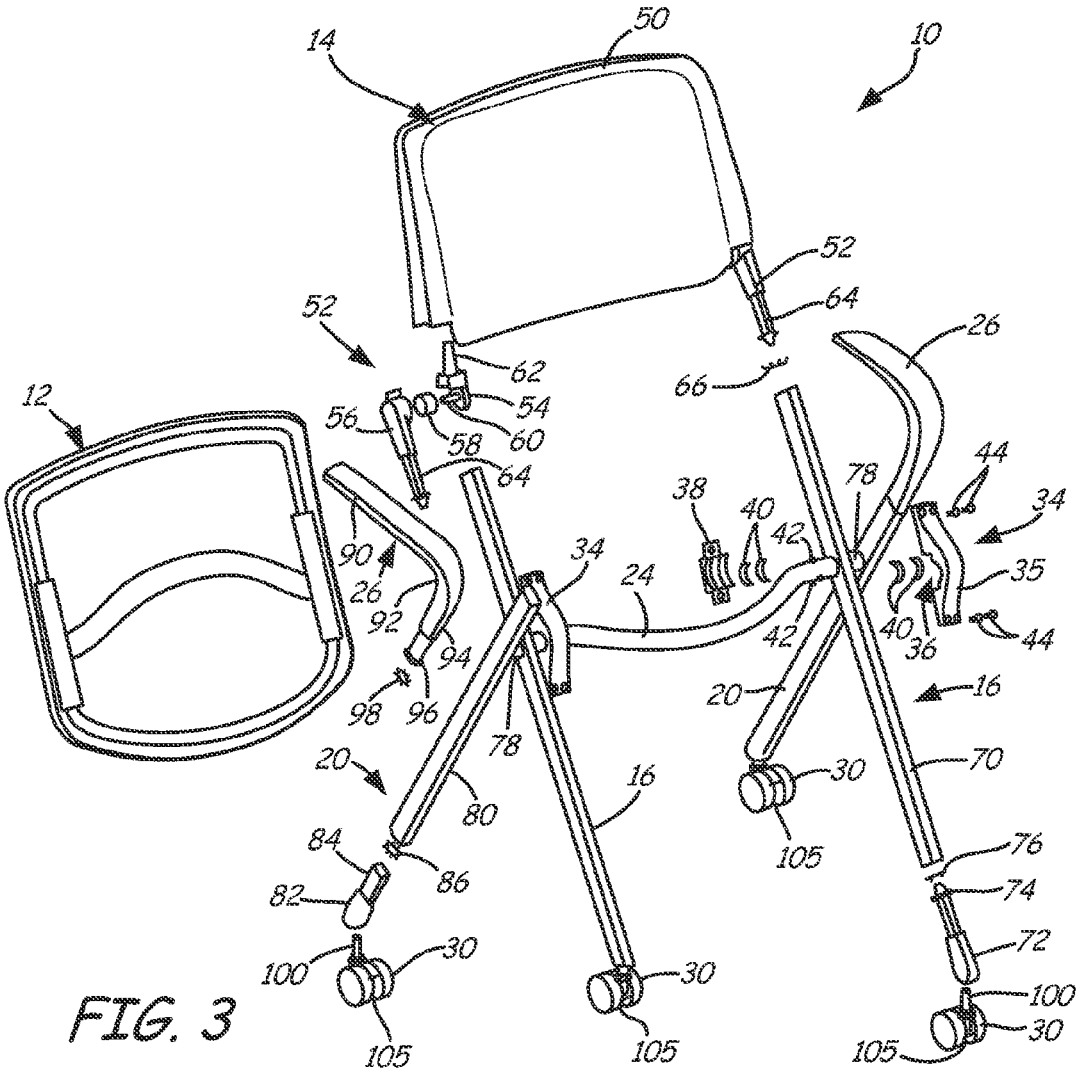
FIG. 3 is an exploded front isometric view of the stackable and nestable chair in the collapsed position.

FIG. 1 is a front isometric view of stackable and nestable chair 10 in an operable position. As used herein, the term "operable position" is used in its broadest sense to refer to a position in which seat 12 is oriented to permit a user to sit upon it (for example, in a substantially horizontal orientation). FIG. 2 is a front isometric view of chair 10 in a collapsed or folded position, wherein seat 12 is disposed in a substantially vertical position such that the front of seat 12 is adjacent back assembly 14. FIG. 3 is an exploded front isometric view of chair 10 in the collapsed position.

Chair 10 includes a leg assembly constructed of a pair of front legs 16 and a pair of rear legs 20. Front legs 16 and rear legs 20 are mutually connected by crossbar 24 that extends transversely between the left legs and the right legs of chair 10. In the embodiment shown, crossbar 24 extends through an aperture in each of front legs 16 and is secured to rear legs 20. As a result of this configuration, front legs 16 are more closely spaced apart than rear legs 20. Chair 10 also includes arms 26 that, in some embodiments, are continuous with rear legs 20. Four wheels or casters 30 are coupled to the bottoms of front legs 16 and rear legs 20.

Seat 12 may be comprised of, for example, a plastic molded seat pan, a formed metal pan, plywood, or compression molded composite. Seat 12 may also include a pad (not shown) on a top surface of the seat pan when in the operable position. Seat 12 may be secured to crossbar 24 with support flanges 34. In the embodiment shown, support flanges 34 each include first bracket 35 including recess 36 that is configured to receive crossbar 24. Support flanges 34 also each include second bracket 38 having a recess that is configured to receive crossbar 24. When assembled, second bracket 38 couples to first bracket 35 to rotatably secure support flange 34 to crossbar 24. Lateral stops 40 are held between mounting bracket 35 and crossbar bracket 38 and interact with tabs 42 on crossbar 24 to prevent support flanges 34 from moving along crossbar 24. Support flanges 34 are secured to an underside of seat 12 with screws 44. Consequently, seat 12 is rotatably secured to crossbar 24 due to the relationship between brackets 35 and 38 and crossbar 24. The curve in crossbar 24 maintains seat 12 in a substantially horizontal position when chair 10 is in the operable position shown in FIG. 1. When seat 12 is rotated to collapse chair 10 as shown in FIG. 2, back assembly 14 interacts with the front of seat 12 to prevent seat 12 from rotating beyond the collapsed position.

Back assembly 14 includes a curved back support 50 that, in some embodiments, is formed from metal, plastic, molded plastic, or a metal frame with mesh. Support member 52 is configured to connect back support 50 to front leg 16. Support member 52 includes upper side post 54, lower side post 56, and sleeve 58. Upper side post 54 includes male feature 60 that is insertable through bushing 58 and into a female feature (not shown) in lower side post 56 to assemble support member 52. Upper pin 62 on each upper side post 54 is insertable into a hole defined on a side of back support 50, and lower pin 64 on each lower side post 56 is insertable into a hole defined by front leg 16. Lock washer 66 secures lower side post 56 to the interior of front leg 16. The structural relationship between upper side post 54 and lower side post 56 allows back support 50 to pivot around an imaginary line that extends axially through bushings 58 of support members 52.

Each of front legs 16 includes elongate tube 70 and end post 72. In some embodiments, elongate tube 70 and end post 72 are comprised of a metallic material, such as steel. End post 72 includes pin 74 that is insertable into elongate tube 70 at an end of elongate tube 70 opposite lower side post 56. Lock washer 76 secures end post 72 to the interior of elongate tube 70. Each elongate tube 70 also includes aperture 78 that crossbar 24 passes through to secure front legs 16 relative to crossbar 24. In some embodiments, the front legs 16 and/or rear legs 20 are rotatable about crossbar 24.

Each of rear legs 20 includes elongate tube 80 and end post 82. In some embodiments, elongate tube 70 is comprised of a metallic material, such as steel, and end post 82 is cast from a metal such as Al or Zn or injection molded in plastic. End post 82 includes pin 84 that is insertable into elongate tube 80 at an end of elongate tube 80 opposite arm 26. Lock washer 86 secures end post 82 to the interior of elongate tube 80. Crossbar 24 is secured to each elongate tube 80 on a side of elongate tube 70 opposite seat 12. In some embodiments, crossbar 24 is secured to each elongate tube 80 be inserting crossbar 24 into an aperture formed in the side of each elongate tube 80. Crossbar 24 may also be welded or rotatably coupled to elongate tubes 80. As discussed above, in this arrangement front legs 16 are more closely spaced apart than rear legs 20. Alternatively, front legs 16 may be spaced further apart than rear legs 20.

Arms 26 each include long portion 90 and short portion 92 connected by curved portion 94. Short portion 92 is configured to be secured to elongate tube 80 by inserting pin 96 into an end of elongate tube 80 opposite end post 82. Lock washer 98 secures pin 96 to the interior of elongate tube 80. When secured to elongate tube 80 of rear leg 20, arm 26 is continuous with rear leg 20. Curved portion 94 transitions arm 26 from short portion 92 in alignment with elongate tube 80 to long portion 90 which is sloped downward from the back to the front of arm 26. In addition, curved portion 94 curves outward from short portion 92 such that the spacing between long portions 90 of arms 26 is greater than the spacing between elongate tubes 80 of rear legs 20.

Casters or wheels 30 are coupled to ends of front legs 16 and rear legs 20 to facilitate movement or placement of chair 10 along a floor. To secure casters 30 to the end of legs 16 and 20, each casters 30 includes a pin 100 configured to mate with a corresponding aperture formed in end post 72 of front legs 16 or end post 82 of rear legs 20. In some embodiments, casters 30 are rigid and roll in a single direction. In other embodiments, caster 30 swivels around pin 100 to facilitate movement in two directions along a floor. Pin 100 may be arranged non-radially with respect to the wheels of the caster. Notch 105 is formed on the bottom of each caster 30 which, as will be described in more detail herein, facilitates proper stacking alignment of multiple chairs 10. In an alternative embodiment, chair 10 is provided without casters or wheels 30.

Figure 4A:
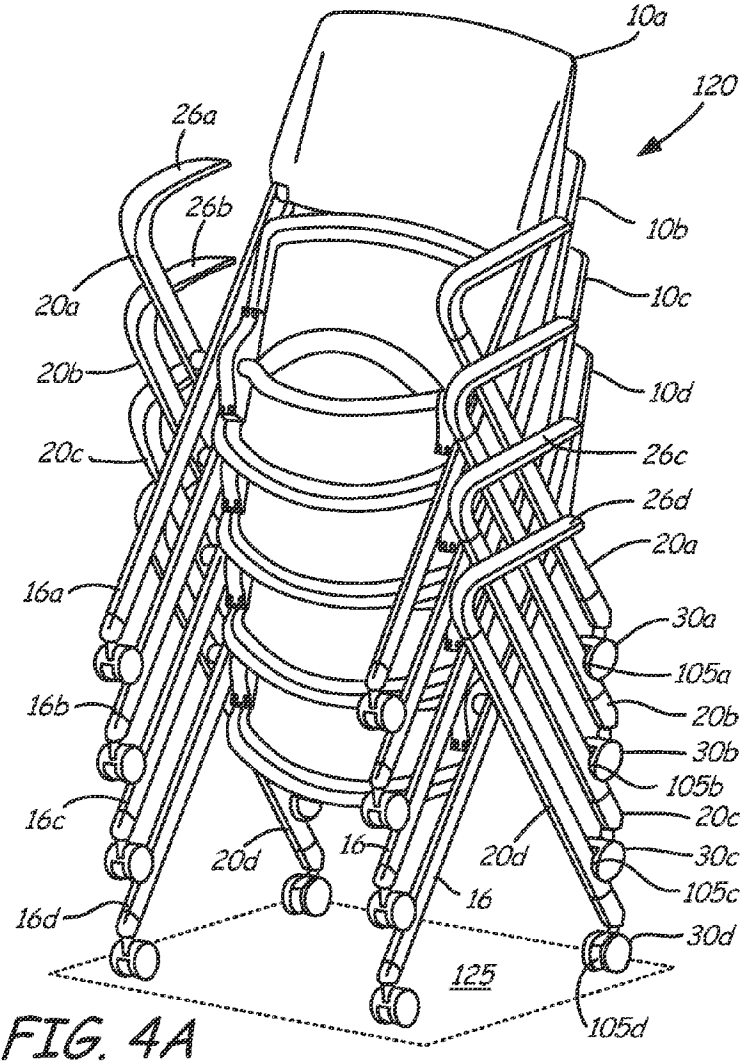
FIG. 4A is an isometric front view of four stackable and nestable chairs in a collapsed position and arranged in a stacked assembly.
Figure 4B:
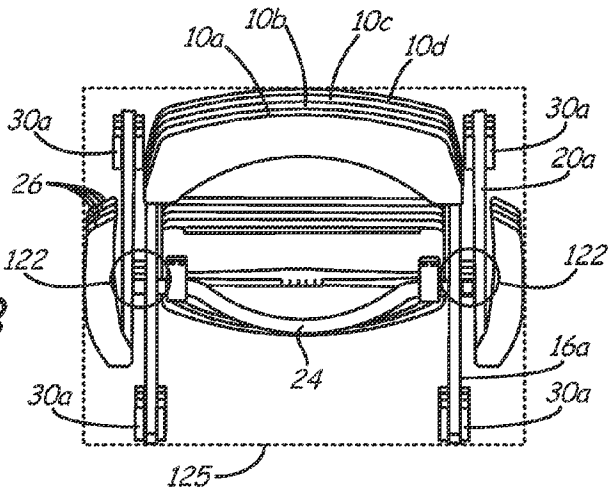
FIG. 4B is a top view of the stacked assembly shown in FIG. 4A.

FIG. 4A is an isometric front view, and FIG. 4B is a top view, of four chairs 10*a*, 10*b*, 10*c*, and 10*d* in a collapsed position and arranged in a stacked assembly 120. Chairs 10*a*-10*d* are substantially similar to or the same as chair 10 shown in FIGS. 1-3, and features of chairs 10*a*-10*d* that are similar to those in FIGS. 1-3 are labeled with corresponding reference numerals. Chairs 10*a*-10*d* may be arranged in stacked assembly 120 for storage or when moving the chairs from storage to a set up location. The greater spacing between arms 26 than rear legs 20 of chair 10 allows front legs 16 and rear legs 20 to fit between arms 26 of the chair 10 immediately below it for stacking. For example, the spacing between arms 26*d* of chair 10*d* allows front legs 16*c* and rear legs 20*c* of chair 10*c* to fit between arms 26*d* and rest on chair 10*d* in a substantially vertical arrangement. Thus, in stacked assembly 120, intersection 122 of front legs 16 and rear legs 20 of chairs 10*a*-10*d* are disposed substantially vertically with respect to each other. Floor footprint 125 of chairs 10*a*-10*d* in stacked assembly 120 is generally the same as the footprint of a single chair 10, allowing more chairs 10 to be stored in less floor space than conventional chair designs. It will be appreciated that while four chairs 10*a*-10*d* are shown in FIGS. 4A and 4B, any number of chairs 10 may be included in stacked assembly 120.

Figure 4C:
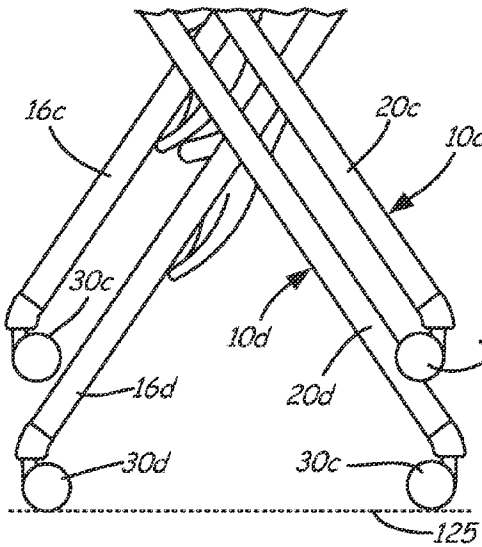
FIG. 4C is a side view of a portion of the stacked assembly shown in FIG. 4A.

To facilitate proper alignment and spacing of chairs 10*a*-10*d* in stacked assembly 120, notch 105 on each rear caster 30 is sized to engage the rear leg 20 of the adjacent chair 10 in stacked assembly 120. For example, casters 30*a* attached to rear legs 20*a* of chair 10*a* engage rear legs 20*b* of adjacent chair 10*b* in stacked assembly 120. In one embodiment, front casters 30 attached to front legs 16 do not engage or touch the front leg of the adjacent chair to allow front casters 30 to rotate freely. FIG. 4C shows chairs 10*c* and 10*d* arranged in this configuration, with front casters 30*c* on front legs 16*c* not engaging front legs 16*d*, but with rear casters 30*c* on rear legs 20*c* engaging rear legs 20*d*. This configuration allows a stack of chairs to nest with other stacks in that front casters 30 can rotate out of the way as rear legs 20 of an adjacent stack pass during nesting of the stacks. In an alternative embodiment, both the front and rear casters 30 engage the legs 16 and 20 of an adjacent chair when the chairs 10 are stacked.

While legs 16 and 20 are shown sized to fit in notches 105 on casters 30 of an adjacent chair, it will be appreciated that other structures and shapes of legs 16 and 20 are possible to interface with or engage casters 30. For example, legs 16 and 20 may alternatively include grooves to engage the wheels on opposing sides of notches 105, or legs 16 and 20 may include raised portions configured to fit within notches 105.

Figure 5A:
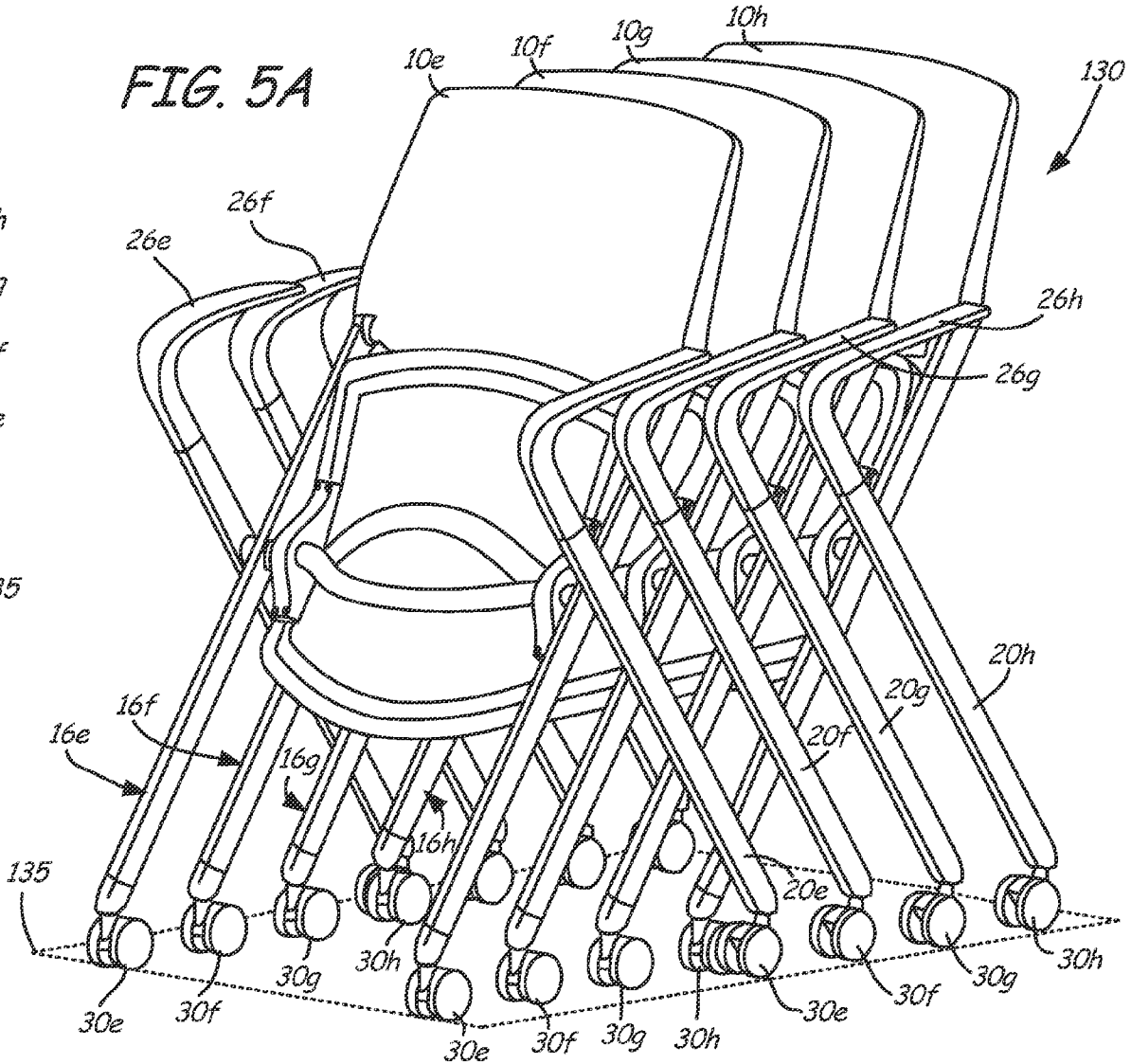
FIG. 5A is an isometric top view of four stackable and nestable chairs in a collapsed position and arranged in a nested assembly.
Figure 5B:
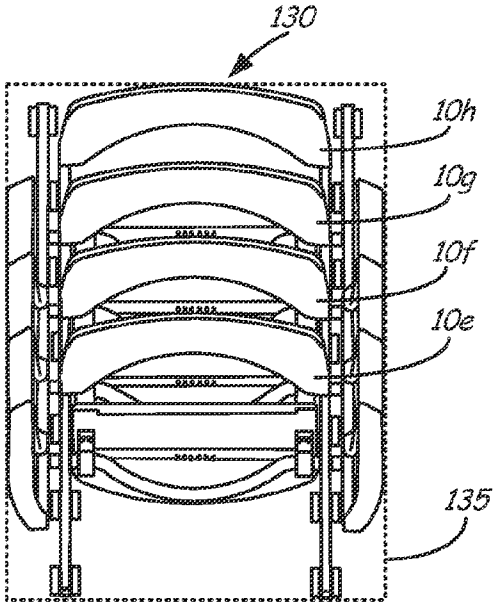
FIG. 5B is a top view of the nested assembly shown in FIG. 5A.

FIG. 5A is an isometric front view, and FIG. 5B is a top view, of four chairs 10*e*, 10*f*, 10*g*, and 10*h* in a collapsed position and arranged in a nested assembly 130. Chairs 10*e*-10*h* are substantially similar to or the same as chair 10 shown in FIGS. 1-3, and features of chairs 10*e*-10*h* are similar to those in FIGS. 1-3 are labeled with corresponding reference numerals. In nested assembly 130, chairs 10*e*-10*h* are disposed substantially horizontally with respect to each other. As discussed above, nesting assembly 130 may be used, for example, in rooms such as conference rooms or meeting spaces where the meeting area may be rearranged from a seating configuration to an open space configuration. Such nesting chairs may be horizontally stacked to reduce the space occupied by the chairs and to avoid having to lift the chairs in a vertically stacked configuration.

The slope of arms 26 and the spacing between rear legs 20 of chair 10 allows chairs 10 to be nested as shown in FIGS. 5A and 5B. In particular, arms 26 each slope downward from the back to the front of chair 10. When one chair 10 is arranged adjacent another chair 10, the back of arm 26 of the front chair rests on arm 26 of the rear chair. For example, when chair 10*e* is positioned adjacent chair 10*f* as shown in FIGS. 5A and 5B, the slope of arms 26*e* allows chair 10*e* to be moved toward chair 10*f* until the back of arms 26*e* contact arms 26*f*. This brings chairs 10*e* and 10*f* into a nested assembly. Chairs 10*g* and 10*h* may similarly be moved toward chairs 10*e* and 10*f* to provide nested assembly 130. The slope of arms 26 are such that chairs 10 may be moved toward each other until there is little or no space between adjacent chairs 10. In addition, the spacing between front legs 16 and rear legs 20 allows chairs 10 to be nested without rear and front casters 30 interfering with each other (e.g., rear caster 30*e* and front caster 30*h*). Thus, floor footprint 135 of chairs 10*e*-10*h* in stacked assembly 130 is smaller than the footprint of four chairs 10 in the operable position, allowing more chairs 10 to be stored in less floor space. It will be appreciated that while four chairs 10*e*-10*g* are shown in FIGS. 5A and 5B, any number of chairs 10 may be included in nested configuration 130.

Figure 6A:
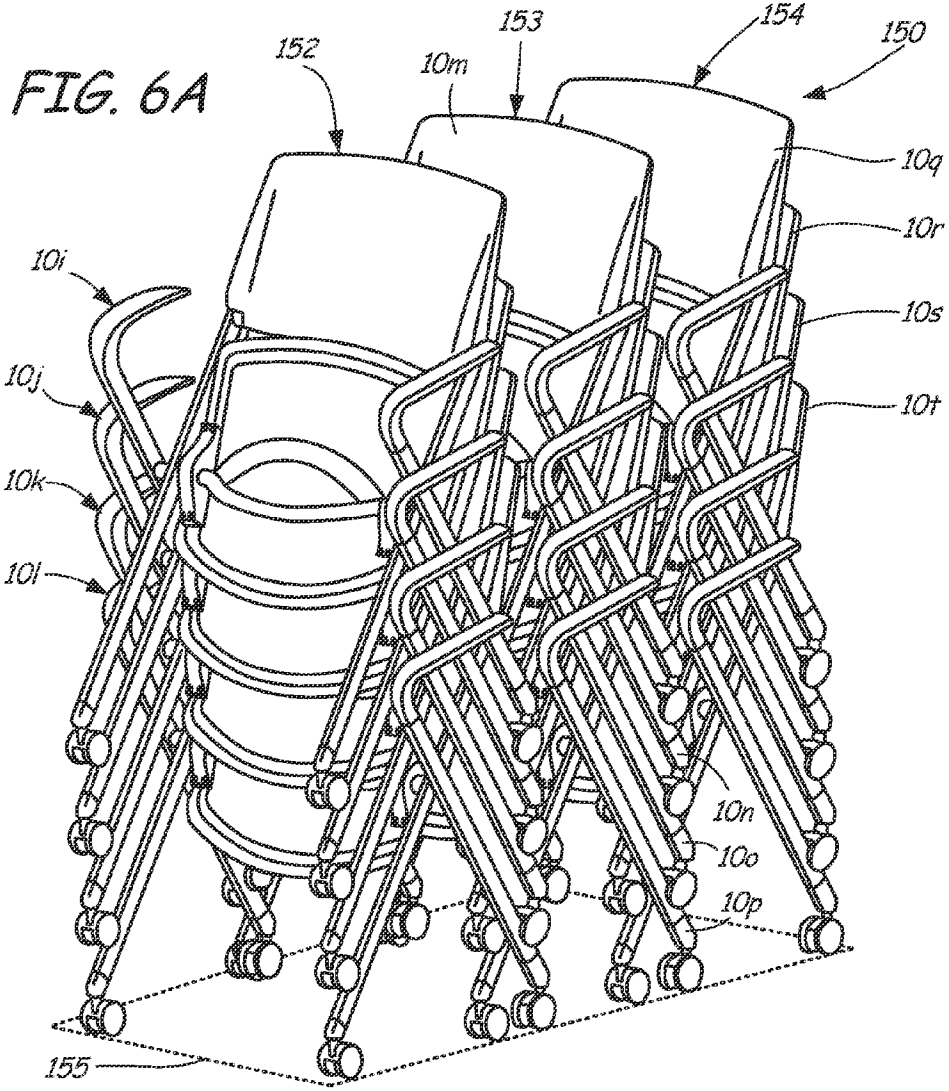
FIG. 6A is an isometric front view of four stackable and nestable chairs in a collapsed position and arranged in a stacked and nested assembly.
Figure 6B:
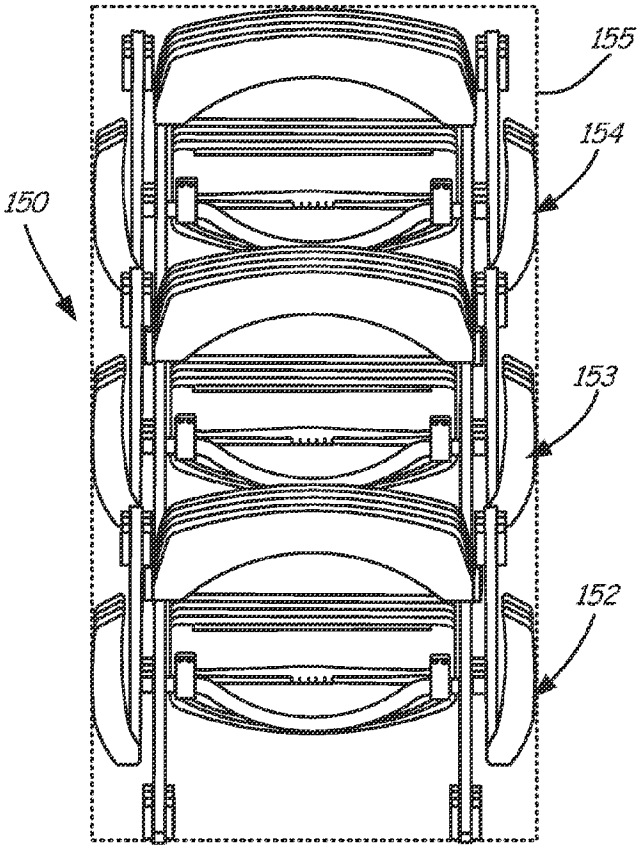
FIG. 6B is a top view of the stacked and nested assembly shown in FIG. 6A.

FIG. 6A is an isometric front view, and FIG. 6B is a top view, of twelve chairs 10*i*, 10*j*, 10*k*, 10*l*, 10*m*, 10*n*, 10*o*, 10*p*, 10*q*, 10*r*, 10*s*, and 10*t* in a collapsed position and arranged in stacked and nested assembly 150. Chairs 10*i*-10*t* are substantially similar to or the same as chair 10 shown in FIGS. 1-3, and features of chairs 10*i*-10*t* are similar to those in FIGS. 1-3 are labeled with corresponding reference numerals. Three nested stacks of four chairs each from stacked and nested assembly 150. That is, first stack 152 includes chairs 10*i*-10*l*, second stack 153 includes chairs 10*m*-10*p*, and third stack 154 includes chairs 10*q*-10*t*. Chairs 10 in each stack 152, 153, and 154 are stacked as described with regard to FIGS. 4A and 4B. Stacks 152, 153, and 154 are nested with each other as described with regard to FIGS. 5A and 5B. Floor footprint 155 of chairs 10*i*-10*t* in stacked and nested assembly 150 is substantially the same as floor footprint 135 of nested assembly 130 since, as discussed above, the floor footprint of chairs 10 in a stacked assembly is substantially the same as the floor footprint for a single chair 10. It will be appreciated that while twelve chairs 10*i*-10*t* are shown in FIGS. 6A and 6B, any number of chairs 10 may be included in stacked and nested configuration 150.

Figure 7:
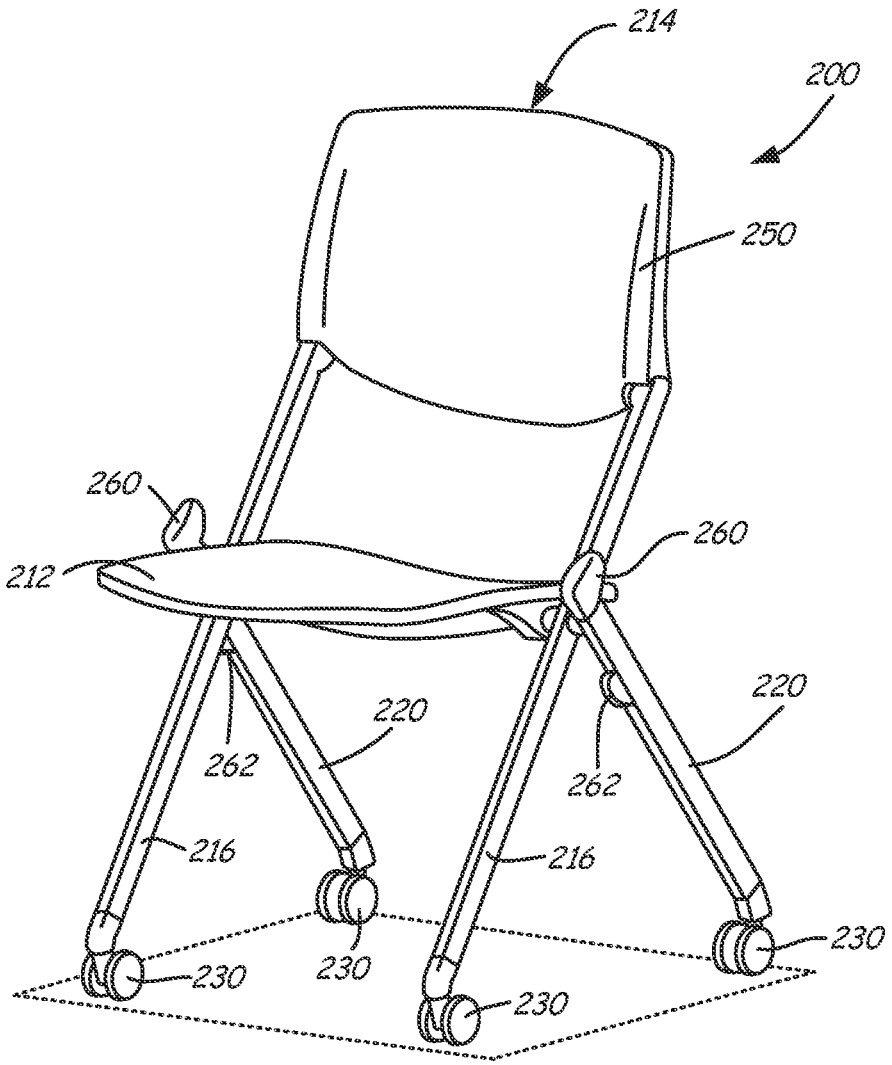
FIG. 7 is an isometric view of another embodiment of a stackable and nestable chair.

FIG. 7 is an isometric view of chair 200 according to another embodiment of the present invention. Chair 200, which is shown in the operable position, has many features similar to chair 10 described above, but does not include arms 26. Elements of chair 200 shown in FIG. 7 include seat 212, back assembly 214, front legs 216, rear legs 220, casters 230, and back support 250. These components may have constructions, assemblies, compositions, and configurations substantially similar to those of seat 12, back assembly 14, front legs 16, rear legs 20, casters 30, and back support 50, respectively, described above with regard to chair 10. Chair 200 includes leg caps 260, which are connected to the end of rear legs 220 proximate seat 212. Chair 200 also includes leg-mounted spacers 262 coupled to the rear legs 220 partway between the leg caps 260 and the casters 230. Leg-mounted spacers 262 are on the side of rear legs 220 facing front legs 216.

Figure 8A:
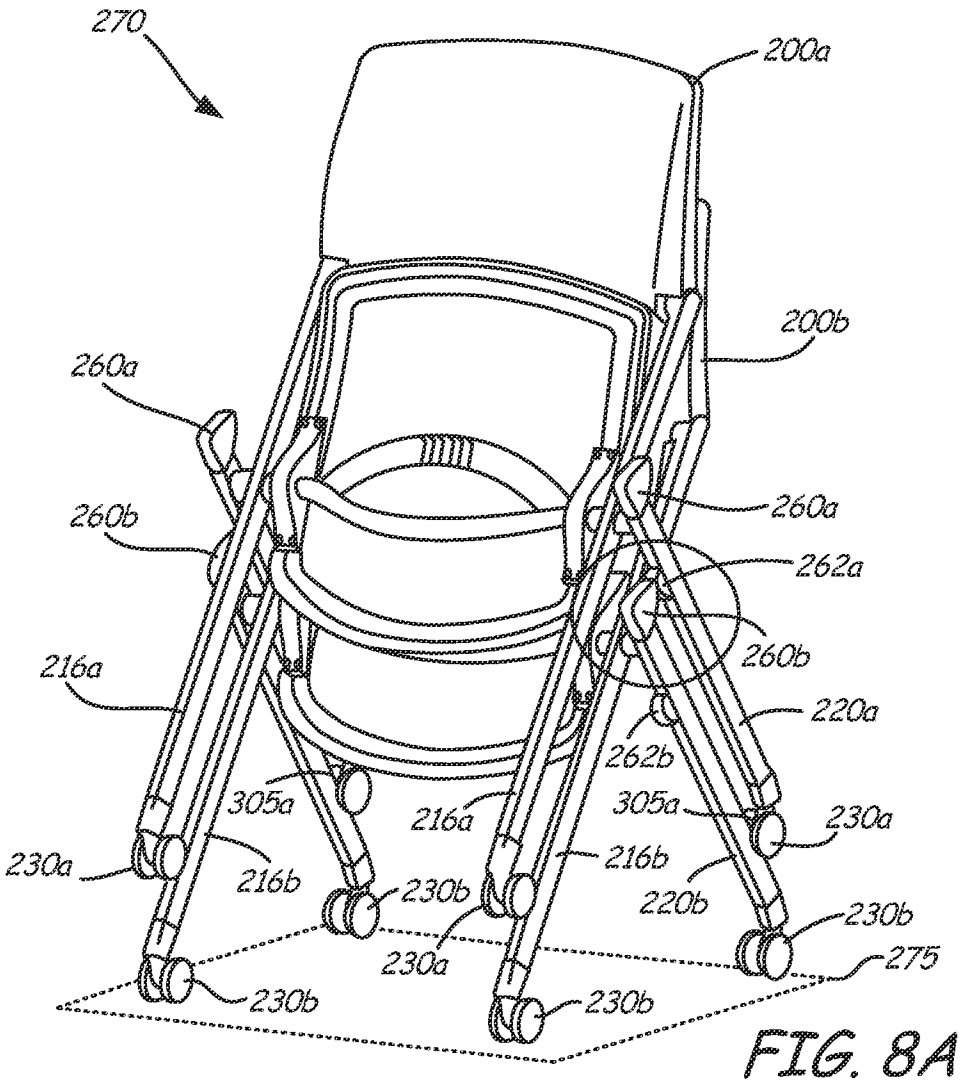
FIG. 8A is an isometric front view of two stackable and nestable chairs shown in FIG. 7 in a collapsed position and arranged in a stacked assembly.

FIG. 8A is an isometric view of two chairs 200*a* and 200*b* in a collapsed position and arranged in a stacked assembly 270. Chairs 200*a* and 200*b* are substantially similar to or the same as chair 200 shown in FIG. 7. Chairs 200*a* and 200*b* may be arranged in stacked assembly 270 for storage or when moving the chairs from storage to a set up location. Floor footprint 275 of chairs 10*a*-10*d* in stacked assembly 270 is generally the same as the footprint of a single chair 200, allowing more chairs 200 to be stored in less floor space than conventional chair designs. It will be appreciated that while two chairs 200*a* and 200*b* are shown in FIG. 8A, any number of chairs 200 may be included in stacked assembly 270. It will also be appreciated that, while not shown, chairs 200 also may be nested in an arrangement similar to chairs 10 shown in FIGS. 5A and 5B, and may be stacked and nested in an arrangement similar to chairs 10 shown in FIGS. 6A and 6B.

Figure 9:
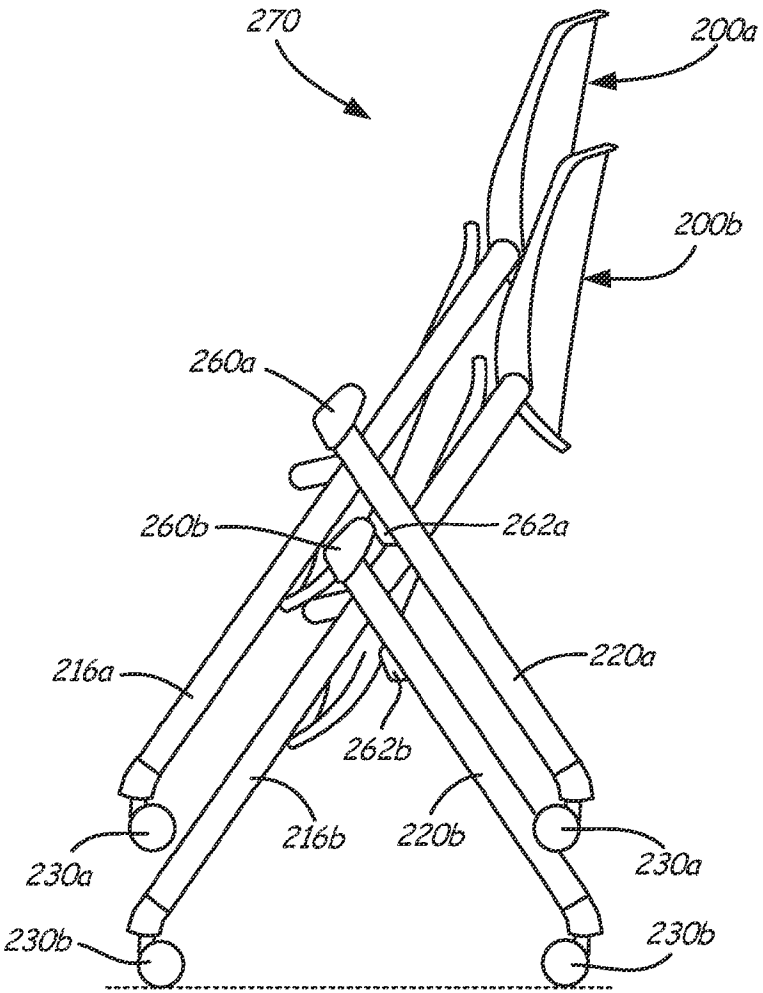
FIG. 9 is a side view of the stacked assembly shown in FIG. 8A.

To facilitate proper alignment and spacing of chairs 200*a* and 200*b* in stacked assembly 270, notch 305 on each rear caster 230 is sized to engage rear leg 220 of the adjacent chair 200 in stacked assembly 270. For example, casters 230*a* attached to rear legs 220*a* of chair 200*a* engage rear legs 220*b* of adjacent chair 220*b* in stacked assembly 270. In one embodiment, front casters 230 attached to front legs 216 do not engage or touch the front leg of the adjacent chair to allow front casters 230 to rotate freely. FIG. 9 shows a side view of chairs 200*a* and 200*b* arranged in this configuration, with front casters 230*a* on front legs 216*a* not engaging front legs 216*b*, but with rear casters 230*a* on rear legs 220*a* engaging rear legs 220*b*. This configuration allows a stack of chairs to nest with other stacks in that front casters 230 can rotate out of the way as rear legs 220 of an adjacent stack pass during nesting of the stacks. In an alternative embodiment, both the front and rear casters 230 engage the legs 216 and 220 of an adjacent chair when the chairs 200 are stacked.

Figure 8B:
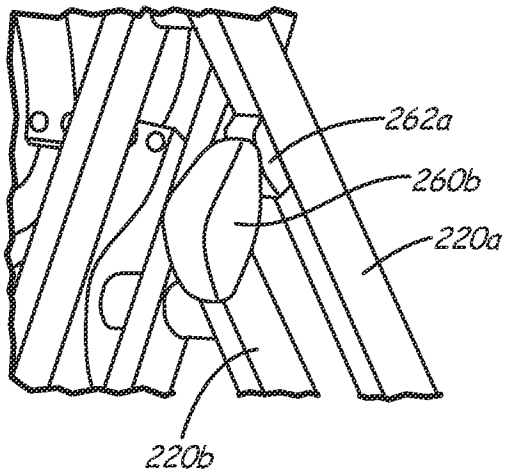
FIG. 8B is an enlarged isometric view of the leg cap of one stackable and nestable chair shown in FIG. 7 engaging the leg-mounted spacer of another stackable and nestable chair.

To further facilitate proper alignment and spacing of chairs 200 in stacked assembly 270, leg caps 260 and leg-mounted spacers 262 are arranged such that when chairs 200 are arranged in stacked assembly 270, leg-mounted spacers 262 engage leg caps 260 of the chair 200 stacked immediately below it in stacked assembly 270. To illustrate, FIG. 8B is an enlarged isometric view of leg cap 260*b* of chair 200*b* engaging leg-mounted spacer 262*a* of adjacently stacked chair 200*a*. Leg caps 260 and leg-mounted spacers 262 are shaped to provide the desired spacing between adjacent rear legs 220 in stacked assembly 270. For example, in the embodiment shown, leg caps 260 include a rounded protrusion that extends from rear legs 220 toward leg-mounted spacers 262 of the adjacently stacked chair. The size of the rounded protrusion the leg-mounted spacers 262 can be selected to provide the desired spacing.

Chairs as described can be easily nested and/or stacked with other similar or identical chairs to minimize the floor space consumed by the chairs when stored in the collapsed position. Nesting chairs may be used, for example, in rooms such as conference rooms or meeting spaces where the meeting area may be rearranged from a seating configuration to an open space configuration. Such nesting chairs may be horizontally nested, such as along a wall or corridor, to minimize space occupied by the nested chairs. Nesting chairs may facilitate setup, takedown, and storage of the chairs.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described.

Other embodiments of the invention are possible. Although the description above contains many specificities, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The following is claimed:

1. A vertically stackable and horizontally nestable chair comprising:

a set of legs that include a pair of rear legs spaced apart by a first distance and a pair of front legs spaced apart by a second distance different than the first distance;

a seat rotatably secured to two of the legs of the set of legs, the seat having a primary surface adapted to support a sitting user;

the vertically stackable and horizontally nestable chair having a first upright configuration in which the seat is in a first position, the first upright configuration being an operable configuration in which the primary surface of the seat is oriented to permit a user to sit upon it; and the vertically stackable and horizontally nestable chair having a second upright configuration in which the seat has rotated to a second position, the second upright configuration being a stackable and nestable configuration in which the vertically stackable and horizontally nestable chair is simultaneously vertically stackable and horizontally nestable with another vertically stackable and horizontally nestable chair in the second upright configuration.

2. The vertically stackable and horizontally nestable chair of claim 1, further comprising:

a pair of arms, each arm being continuous with one of the rear legs, wherein each arm is downwardly sloped from a back portion to a front portion, and wherein the pair of arms are spaced apart by a distance that is greater than the first distance.

3. The vertically stackable and horizontally nestable chair of claim 2, wherein the pair of arms are configured to be substantially parallel with a pair of arms of an adjacently nested vertically stackable and horizontally nestable chair.

4. The vertically stackable and horizontally nestable chair of claim 2, wherein each arm and continuous rear leg is substantially L-shaped.

5. The vertically stackable and horizontally nestable chair of claim 1, further comprising:

a pair of spacers, each spacer of the pair of spacers being attached to a rear leg of the pair of rear legs, the spacers being positioned to engage a rear leg of an adjacently stacked vertically stackable and nestable chair.

6. The vertically stackable and horizontally nestable chair of claim 5, wherein each rear leg includes a rear leg cap, and wherein each spacer of the pair of spacers is positioned to engage a rear leg cap of an adjacently stacked vertically stackable and nestable chair.

7. The vertically stackable and horizontally nestable chair of claim 1, wherein the vertically stackable and horizontally nestable chair has a first footprint, wherein a stack of a plurality of vertically stackable and horizontally nestable chairs has a second footprint, and wherein the first and second footprints are substantially the same.

8. A first stackable and nestable chair comprising:

a leg assembly including two front legs and two rear legs, the front legs being connected to the rear legs by a crossbar, wherein the two rear legs are spaced apart by a first distance and the two front legs are spaced apart by a second distance less than the first distance; the two front and rear legs are configured to contact a ground surface in an upright position;

a seat having a primary sitting surface and being pivotally mounted to the crossbar, the seat being configured to rotate between an operable position and a collapsed position, wherein the seat is supported by the crossbar and is oriented to permit a user to sit upon the primary sitting surface in the operable position;

wherein the leg assembly and seat are configured such that, when the seat is in the collapsed position and the first stackable and nestable chair is in the upright position, the stackable and nestable chair is capable of being simultaneously arranged in a stacked assembly with a second stackable and nestable chair and a nested assembly with a third stackable and nestable chair.

9. The first stackable and nestable chair of claim 8, wherein the stackable and nestable chair is capable of being simultaneously arranged in a vertically stacked assembly with the second stackable and nestable chair and a horizontally nested assembly with the third stackable and nestable chair when the seat is in the collapsed position and the first stackable and nestable chair is in the upright position.

10. The first stackable and nestable chair of claim 8, further comprising:

a pair of arms that are continuous with the rear legs, wherein each arm is downwardly sloped from a back portion to a forward portion.

11. The first stackable and nestable chair of claim 10, wherein the back portion of each arm is configured to contact a forward portion of a corresponding arm of the third stackable and nestable chair.

12. The first stackable and nestable chair of claim 10, wherein the forward portion of each arm is configured to contact a back portion of a corresponding arm of the third stackable and nestable chair.

13. The first stackable and nestable chair of claim 10, wherein the pair of arms are configured to be substantially parallel with a pair of arms of the third stackable and nestable chair.

14. The first stackable and nestable chair of claim 8, wherein a stack of stackable and nestable chairs is nestable with another stack of stackable and nestable chairs.

15. A stackable and nestable chair comprising:

a pair of rear legs spaced apart by a first distance and configured to contact a ground surface in an upright configuration;

a pair of front legs spaced apart by a second distance;

a seat configured to rotate between an operable position and a collapsed position; and a pair of fixed arms that are coupled to the rear legs, wherein the pair of fixed arms are spaced apart by a third distance greater than the first distance, wherein, when the seat is in the collapsed position and the stackable and nestable chair is in the upright configuration, the seat, rear legs, front legs, and arms enable the stackable and nestable chair to simultaneously nest with a first similarly configured stackable and nestable chair in the operable configuration and stack with a second similarly configured stackable and nestable chair.

16. The stackable and nestable chair of claim 15, wherein, when the seat is in the collapsed position, the front legs are configured to pass between rear legs of the first similarly configured stackable and nestable chair.

17. The stackable and nestable chair of claim 15, wherein the pair of fixed arms are configured to be substantially parallel with a pair of fixed arms of the first similarly configured stackable and nestable chair.

18. The stackable and nestable chair of claim 15, wherein the pair of fixed arms are downwardly sloped from a back to a front of the stackable and nestable chair.

19. The stackable and nestable chair of claim 15, wherein the pair of fixed arms include curved portions.

20. The stackable and nestable chair of claim 15, wherein the stackable and nestable chair has a first footprint, wherein a stack of a plurality of stackable and nestable chairs has a second footprint, and wherein the first and second footprints are substantially the same.

* * * * *